US005682188A

United States Patent [19]

Meyer et al.

[11] Patent Number: 5,682,188

[45] Date of Patent: Oct. 28, 1997

[54] PRINTHEAD WITH UNPASSIVATED HEATER RESISTORS HAVING INCREASED RESISTANCE

[75] Inventors: Neal W. Meyer, Corvallis, Oreg.; Eric G. Hanson, Burlingame, Calif.; Alfred Pan, Sunnyvale, Calif.; Glenn W. Weberg, Mountain View, Calif.

[73] Assignee: Hewlett-Packard Company, Palo Alto, Calif.

[21] Appl. No.: 407,301

[22] Filed: Mar. 16, 1995

Related U.S. Application Data

[63] Continuation of Ser. No. 942,566, Sep. 9, 1992, abandoned.

[51] Int. Cl.[6] ..... B41J 2/05

[52] U.S. Cl. ..... 347/61; 347/61

[58] Field of Search ..... 347/62, 61, 57, 347/63

[56] References Cited

U.S. PATENT DOCUMENTS

| | | | |
|---|---|---|---|
| 4,296,421 | 10/1981 | Hara et al. | 347/48 |
| 4,313,124 | 1/1982 | Hara | 347/57 |
| 4,336,548 | 6/1982 | Matsumoto | 347/64 |
| 4,490,728 | 12/1984 | Vaught et al. | 347/60 |
| 4,490,731 | 12/1984 | Vaught | 347/88 |
| 4,535,343 | 8/1985 | Wright et al. | 347/64 |
| 4,590,482 | 5/1986 | Hay et al. | 347/19 |
| 4,631,555 | 12/1986 | Ikeda et al. | 347/58 |
| 4,716,423 | 12/1987 | Chan et al. | 347/65 |
| 4,931,813 | 6/1990 | Pan et al. | 347/62 |

FOREIGN PATENT DOCUMENTS

| | | | |
|---|---|---|---|
| 59-135169 | 8/1984 | Japan | 346/75 |

*Primary Examiner*—Benjamin R. Fuller
*Assistant Examiner*—Craig A. Hallacher

[57] ABSTRACT

A thermal inkjet printhead includes unpassivated heater resistors whose resistive material is doped, preferably with oxygen, nitrogen or an equivalent dopant, for increasing the resistance of the material. By increasing the resistance of the resistive material through doping, the drive currents for generating heat within the resistors need not be changed from levels which inkjet printers are presently designed to work with. The printhead of the invention can thus be used in place of a standard printhead without modification to the printer.

4 Claims, 1 Drawing Sheet

PRINTHEAD WITH UNPASSIVATED HEATER RESISTORS HAVING INCREASED RESISTANCE

CROSS REFERENCE TO RELATED APPLICATION(S)

This is a file wrapper continuation of application Ser. No. 07/942,566 filed on Sep. 9, 1992, now abandoned.

BACKGROUND OF THE INVENTION

This invention generally relates to thermal inkjet printing. More particularly, this invention relates to the design of heater resistors within the printhead.

Thermal inkjet printers typically have a printhead mounted on a carriage which traverses back and forth across the width of paper being fed through the printer. The printhead includes a vertical array of nozzles which faces the paper. Ink-filled channels in communication with the nozzles also connect to an ink source such as a reservoir. As ink in the channels is expelled as droplets through the nozzles onto the paper, more ink fills the channels from the reservoir. Bubble-generating heater resistors in the channels near the nozzles are individually addressable by current pulses. These pulses are print commands representative of information to be printed such as video signals from a monitor. Each ink droplet expelled from the nozzles prints a picture element or pixel on the paper.

The current pulses are applied to the heater resistors to momentarily vaporize the ink in the channels into bubbles. The ink droplets are expelled from each nozzle by the growth and then collapse of the bubbles.

The heater resistors, which generate the heat for vaporizing the inks, can be fabricated as a resistive layer on a silicon substrate having a silicon dioxide ($SiO_2$) layer. These layers together with other layers above the resistive layer form a heating element. The resistive layer can be deposited on the substrate using standard thin-film processing techniques and typically comprises a layer of tantalum aluminum (TaAl) up to several hundred Angstroms (Å) thick.

On the scale of the heater resistor, the shock of the ink bubble collapsing upon the resistive layer is a source of significant mechanical fatigue. The problem of fatigue is aggravated in printers which provide for burst mode operation, in which ink droplets can be formed and expelled over fifty thousand times a second.

In addition to the mechanical shock produced by collapsing bubbles, the resistor is subject to thermal fatigue when it is switched on and off at high frequencies. Thermal fatigue is suspected to aggravate a crack nucleation process, eroding the structural integrity of the resistor. Extended burst-mode operation can additionally cause heat accumulation, compounding the problem of thermal fatigue. The turbulent ink can also be quite corrosive on the resistive layer and subject it to corrosion and erosion.

A conventional technique for protecting the resistive layer is to cover it with one or more passivation layers. For example, a TaAl resistor can be coated with a layer of silicon nitride, silicon carbide or, more commonly, both. In addition, an overcoat of tantalum or other metal is applied over the passivation layers as an additional impact buffer and as a means for evacuating leakage current. These additional layers reduce the intensity of the impact stress wave induced by the collapsing bubble on the resistor to protect it from cavitation damage.

These passivation layers, however, have their drawbacks. For one, there is the additional manufacturing complexity involved. Typically seven film layers are required as opposed to two layers for an unpassivated resistor structure. Correspondingly, five (rather than two) masking steps are required. The increased manufacturing complexity also increases costs and decreases yields on a per wafer basis. A second drawback is that the passivation layers impede the dissipation of heat. The unwanted accumulation of heat can affect ink viscosity significantly, which is a critical variable in determining droplet size and velocity. Furthermore, substantial heat accumulation increases stress levels and thus failure rates of the various layers of the heating element. A third drawback of passivated resistors is that the turn-on voltage varies with passivation thickness. This variation makes it more difficult to determine the proper driving voltage for a given resistor. Driving the resistor with too low a voltage can result in insufficient bubble formation, while driving the resistor with too high a voltage rapidly diminishes resistor life through excessive heating.

One solution to the drawbacks posed by passivation layers is to remove them and increase the thickness of the resistive layer. This approach is described and shown in U.S. Pat. No. 4,931,813, commonly assigned to the present assignee and hereby incorporated by reference. The additional thickness of the resistive layer obviates the need for the passivation layers. The resistor can be constructed to contact fluid in the form of ink or vapor in the form of a thermal bubble in the channel. The resistive layer is homogeneous in that a single material, generally a metal alloy such as TaAl, can be used to form the resistor.

Increasing the thickness of the resistive layer, however, reduces the resistance of the heater resistor because its volume is now greater than before while its resistivity is unchanged. To generate the same heat, the drive current (which generates the pulses) must be increased. Increasing the drive current, in turn, may require a redesign of the printer control circuitry within the printer or printhead.

SUMMARY OF THE INVENTION

An object of the invention, therefore, is to provide the benefits of an unpassivated heater resistor without requiring a redesign of the printhead or printer using such resistor.

Another object of the invention is to provide an unpassivated heater resistor of greater thickness that has the resistance of a smaller heater resistor presently used in thermal inkjet printheads.

A printhead according to the invention includes an ink source for supplying ink, an orifice, and a channel for conveying the ink from the ink source to the orifice. A circuit supplies a signal to control the expulsion of ink from the printhead. A resistive layer in the printhead is responsive to the signal from the circuit for generating heat to expel ink from the channel through the orifice. The resistive layer may comprise a first material doped with a second material to increase the resistivity of the resistive layer above the resistivity of the first material.

In a preferred embodiment the resistive layer may be constructed to contact ink within the channel. The first material may be TaAl and the second material may be oxygen, nitrogen or an equivalent dopant. The resistive layer is preferably at least 5000 Å thick.

The foregoing and other objects, features, and advantages of the invention will become more apparent from the following detailed description of a preferred embodiment, which refers to the following drawings.

DESCRIPTION OF THE PREFERRED EMBODIMENT

Figure 1:
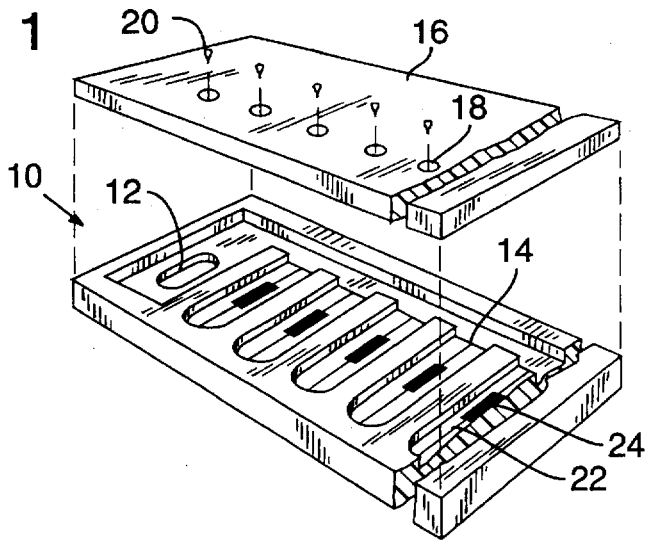
FIG. 1 is an exploded view of a drop generating mechanism within a printhead according to the invention.

Referring to FIG. 1, a drop generating mechanism within a printhead 10 according to the invention includes an ink source 12 for supplying ink, channels 14 for conveying ink, and an orifice plate 16 with orifices 18 through which droplets 20 are expelled from the channels 14. The droplets are propelled toward a recording medium such as paper in an inkjet printer, as is known in the art. Heater resistors 22 are shown symbolically in FIG. 1 and positioned so that ink within a channel 14 can be expelled through a respective orifice 18 when a resistor 22 generates sufficient heat to vaporize the ink. The resistors 22 are arranged in series with respective pairs of conductors 24 which provide the current, the electrical energy of which is converted to thermal energy by the resistors 22.

Figure 2:
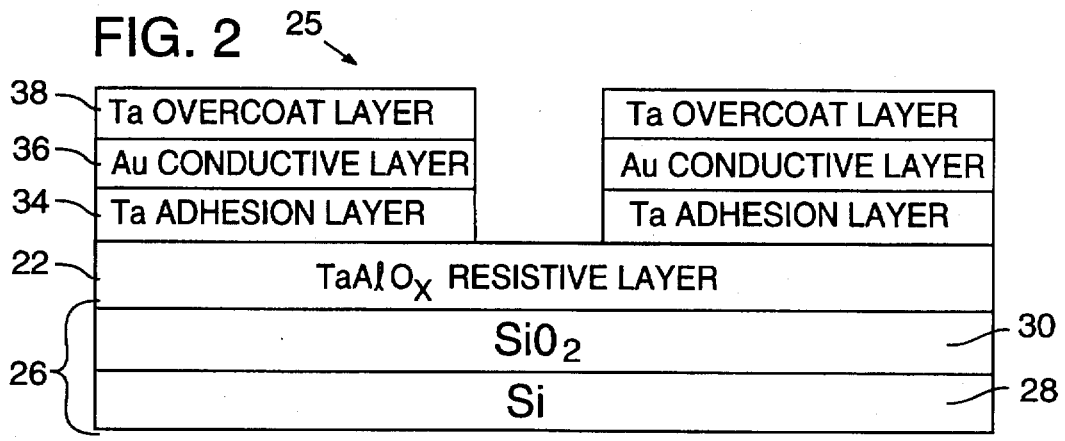
FIG. 2 is a cross-section view of a heating element within the drop generating mechanism of FIG. 1.

FIG. 2 shows a cross sectional view of a heating element 25 according to the invention. The element 25 includes a resistor 22 in the form of a resistive layer fabricated on a semiconductor structure 26 that includes a silicon substrate 28 of about 675 μm, and a thermal barrier layer 30 of silicon dioxide ($SiO_2$) or equivalent thermal oxide of about 1.7 μm. Resistive layer 22 is deposited over the thermal barrier layer 30, followed by deposition of an adhesion layer 34, a conductive layer 36 for forming conductors 24 and an overcoat layer 38. A preferred resistive material for the resistive layer is tantalum aluminum oxide ($TaAlO_x$), where x can vary so that oxygen is within a range of about 0.1% to 10% of the weight percent of the TaAlO compound. The adhesion layer 34 and overcoat 38 can be a refractory metal such as tantalum and the conductive layer 36 can be composed of gold or equivalent conductor. The overcoat 38 may also be of tantalum. The conductive layer can be about 5,000 Å thick. The resistive layer 22 can be more than 1000 Å thick to improve on the performance of thinner unpassivated resistors. This figure can be at least doubled to achieve performance comparable to passivated resistor structures. In the illustrated embodiment, the thickness of the resistive layer 22 is about 5000 Å to provide superior life characteristics.

Figure 3:
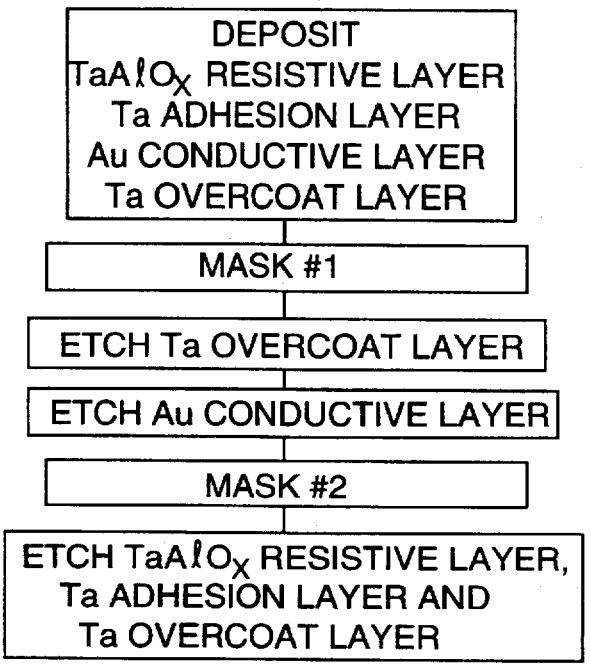
FIG. 3 is a flowchart summarizing the steps for producing the heating element of FIG. 2.

The processing steps for constructing the heater element 25 are summarized in FIG. 3. Starting with a wafer having a silicon substrate 28, a thermal $SiO_2$ barrier is first deposited. The $TaAlO_x$ resistive layer is then sputter deposited onto the wafer to form a film of about 5000 Å in thickness. The preferred atomic weight percent range of both Ta and Al in the $TaAlO_x$ compound is 40% to 60% each. The oxygen doping level is chosen in the range of 0.1 to 10 atomic weight percent to yield a sheet resistance of about ten ohms per square. The deposition is followed by sputter depositions to form the tantalum adhesion layer 34, the gold conductive layer 36 and the tantalum overcoat layer 38 of about 100 Å, 5000 Å, and 200 Å, respectively.

These depositions are followed by two masking steps. The first mask step includes an etch of the tantalum overcoat 38 and an etch of the gold conductive film 36. The second mask step includes an etch of the adhesion layer 34, resistive layer 22 and the tantalum overcoat 38 to clear bonding pads and expose a resistive surface 40 within a channel 14. A preferred set of detailed processing steps is set forth for Appendix A.

The resistive layer 22 comprises in the preferred embodiment a first material such as TaAl doped with a second material such as oxygen to increase the resistivity of the resistive layer above the resistivity of the first material. Preferably the oxygen doping concentration is 0.1 to 10 atomic weight percent. By increasing the resistivity in this manner, the thickness of the resistive layer 22 can be increased to 5000 Å or more so that the resistance of the layer is the same as the resistance of passivated resistors found in conventional printheads. The greater thickness provides the required protection against structural and thermal fatigue.

Other alternative embodiments are, of course, possible. The first material may be any of several refractory materials and the second material may be an impurity such as oxygen, nitrogen or equivalent dopant. The substrate 28 may be any of a number of materials such as glass and the thermal barrier layer 30 may be formed from other equivalent materials as well.

Having illustrated and described the principles of the invention in a preferred embodiment, it should be apparent to those skilled in the art that the invention can be modified in arrangement and detail without departing from such principles.

We recognize that the principles of this invention can be applied to a wide variety of equivalent embodiments. For example resistive materials other then TaAl can be doped with impurities other than oxygen. And deposition techniques other than sputtering may be employed. Therefore, the illustrated embodiment should be considered only as an example of a preferred form of the invention and not as a limitation on the scope of the invention. We claim all such modifications and equivalents coming within the scope and spirit of the following claims.

APPENDIX A

| | | |
|---|---|---|
| A | Deposition | |
| | 1 | Deposit oxide layer |
| | 2 | Deposit doped resistive layer |
| | 3 | Deposit refractory metal adhesion layer and conductive layer |
| | 4 | Deposit refractory metal overcoat |
| B | Mask 1 | |
| | 5 | Ash substrate |
| | 6 | Prebake substrate |
| | 7 | Spin photo resist |
| | 8 | Soft bake photo resist |
| | 9 | Align and expose photo resist |
| | 10 | Develop photo resist |
| C | Etch 1 | |
| | 11 | Hard bake photo resist |
| | 12 | Etch overcoat to clear resistors and between traces |
| | 13 | Etch conductive layer to clear resistors and between traces |
| | 14 | Strip photo resist |
| | 15 | Rinse and dry |
| D | Mask 2 | |
| | 16 | Ash substrate |
| | 17 | Prebake substrate |
| | 18 | Spin photo resist |
| | 19 | Soft bake photo resist |
| | 20 | Align and expose photo resist |
| | 21 | Develop photo resist |

APPENDIX A-continued

| | | |
|---|---|---|
| E | Etch 2 | |
| | 22 | Hard bake photo resist |
| | 23 | Etch overcoat to clear pads and etch adhesion layer and resistive layer to clear between traces |
| | 24 | Strip photo resist |
| | 25 | Rinse and dry |
| F | Laminate barrier | |
| G | Attach orifice | |
| H | Dice wafer | |
| I | Assemble printhead | |

We claim:

1. A printhead for a printer, comprising:

an ink source for supplying ink;

an orifice;

a channel for conveying ink from the ink source to the orifice;

a doped resistive layer of tantalum aluminum oxygen $TaA10_x$ for generating heat to expel ink from the channel through the orifice, wherein the dopant of the layer is within a range of about 0.1% to 10% of the weight percent of the layer; and a conductor for supplying a signal to control expulsion of ink by the resistive layer.

2. The printhead of claim 1 wherein the resistive layer is constructed to contact ink within the channel.

3. The printhead of claim 1 wherein the resistive layer is at least 5000 Å thick.

4. A printhead for a printer, comprising:

an ink source for supplying ink;

an orifice;

a channel for conveying ink from the ink source to the orifice;

a resistive layer for generating heat to expel ink from the channel through the orifice, the resistive layer consisting essentially of tantalum aluminum oxygen wherein the oxygen portion of the layer is within a range of about 0.1% to 10% of the weight percent of the layer; and a conductor for supplying a signal to control expulsion of ink by the resistive layer.

* * * * *